US005088387A

United States Patent [19]

Wicks, III et al.

[11] Patent Number: 5,088,387

[45] Date of Patent: Feb. 18, 1992

[54] FLUIDIZED BED FLUID PRESSURE REGULATOR

[75] Inventors: Moye Wicks, III; Boyd B. Moore, both of Houston, Tex.

[73] Assignee: Shell Oil Company, Houston, Tex.

[21] Appl. No.: 703,581

[22] Filed: May 20, 1991

Related U.S. Application Data

[63] Continuation of Ser. No. 439,914, Nov. 20, 1989, abandoned.

[51] Int. Cl.[5] ..... B64D 13/02

[52] U.S. Cl. ..... 34/15; 138/26; 34/51; 454/238; 454/255; 454/340

[58] Field of Search ..... 98/15; 138/40–42, 138/26

[56] References Cited

U.S. PATENT DOCUMENTS

| | | | |
|---|---|---|---|
| 1,121,700 | 12/1914 | Wiedmann | 138/40 |
| 2,651,985 | 9/1953 | Warstler | 98/1.5 |
| 4,344,356 | 8/1982 | Casteron et al. | 98/1.5 X |
| 4,593,478 | 6/1986 | Stendahl | 138/42 X |
| 4,704,951 | 11/1987 | Pruchon | 98/1.5 |
| 4,860,783 | 8/1989 | Megee et al. | 138/41 X |

*Primary Examiner*—William E. Tapolcai

[57] ABSTRACT

A method and apparatus for venting purge fluid from an enclosed housing to maintain a positive known reference pressure differential between the housing and the variable pressure atmosphere surrounding the housing. The apparatus utilizes a specially designed fluidized bed to vent the purge fluid while maintaining a positive known reference back pressure. The fluidized bed automatically compensates for changes in the temperature or pressure of the atmosphere surrounding the housing.

23 Claims, 1 Drawing Sheet

FLUIDIZED BED FLUID PRESSURE REGULATOR

This is a continuation of application Ser. No. 07/439,914, filed Nov. 20, 1989, now abandoned.

BACKGROUND OF THE INVENTION

The invention relates to a method and apparatus for venting an enclosed housing to maintain a positive known reference pressure in the housing in relation to the variable pressure atmosphere surrounding the housing. In many industrial applications it is often desirable to maintain a positive known reference pressure within an enclosed housing, for example a piece of machinery, in order to exclude the surrounding atmosphere from the machinery. The problem also occurs when delicate instruments are lowered into boreholes that are drilled to produce petroleum deposits. In this case the borehole fluids must be excluded from the housing containing the instruments.

One procedure for excluding the atmosphere from an enclosed space is to fill the enclosed space with a purge fluid whose pressure slightly exceeds the surrounding atmosphere. A simple method for maintaining a positive pressure in an enclosed space is to supply the space with a constant flow of purge fluid and constantly vent the fluid from the enclosed space to maintain the positive known reference pressure. The enclosed space has traditionally been vented using various mechanical-type pressure valves that respond to the pressure of the atmosphere surrounding the enclosed space to control the pressure within the space. While these are satisfactory under some conditions, they are unreliable under varying pressures and temperatures. This is a particular problem in the case of instruments lowered into boreholes where the pressure at the bottom of the borehole may be several hundred pounds in contrast to a surface pressure of substantially zero pounds and the temperature at the bottom of the borehole may be several hundreds degrees F in contrast to a surface temperature of a few tens of degrees F. Mechanical devices have been unreliable under these varying conditions and other means have been used in an attempt to maintain a positive known reference pressure in the instrument housing.

Additional problems also arise as a result of the limited space in tools lowered in the borehole for mounting large mechanical valves. Most mechanical valves are large and contain movable parts that tend to malfunction in a borehole environment. All such valves have inherent hystersis problems.

SUMMARY OF THE INVENTION

The present invention solves the above problems by utilizing a fluidized bed column for maintaining the desired positive known reference pressure on the enclosed space. In particular, a constant flow of purge fluid is supplied to the enclosed space and the space vented through the fluidized bed column. The fluidized bed contains suitable particles so that the pressure drop of the fluid flowing through the bed produces the desired positive known reference pressure differential. The fluidized bed will maintain a constant positive known reference pressure over a wide range of flow rates and does not require any mechanical devises. In addition, the fluidized bed is seld-adjusting in response to the pressure and temperature of the atmosphere surrounding the enclosed space.

In another aspect, the present invention provides an improved apparatus for contacting a fluid with a fluidized bed of solid particles. This apparatus comprises: a vessel enclosing an essentially vertical fluid flowpath; a means for distributing fluid into the essentially vertical fluid flowpath in the bottom portion of the flowpath, and two helical elements would in opposite directions within the flowpath. This apparatus is capable of maintaining fluidization over a wide range of fluid flow rates and within a vessel which is much smaller than vessels of the prior art which fluidization could be maintained.

The fluidized bed column of the present invention has a large length-to-diameter ratio in order to provide a compact device for venting the purge fluid. The pressure drop in a fluidized bed is related to the length of the bed and only a small diameter bed is required to provide the desired pressure drop. Use of a small diameter column is also desirable for compactness especially in the case of tools that are designed to be lowered into boreholes, but it does pose several problems. One of the most difficult problems is the tendency of the purge fluid to form bubbles in a small diameter column and not maintain the bed in a uniform fluidization pattern. Once bubbles form, the bed becomes non-fluidized and the pressure drop across the bed pulsates widely. It has been discovered that the bubbles can be prevented from forming by placing helically wound wires in the bed. In particular, two wires having a length substantially equal to the length of the column are wound in opposite directions. The preformed wires are disposed in the column and effectively break up any bubbles that form. The bed is maintained in a uniform fluidized state and a constant pressure drop exists across the bed.

DESCRIPTION OF PREFERRED EMBODIMENTS

Figure 1:
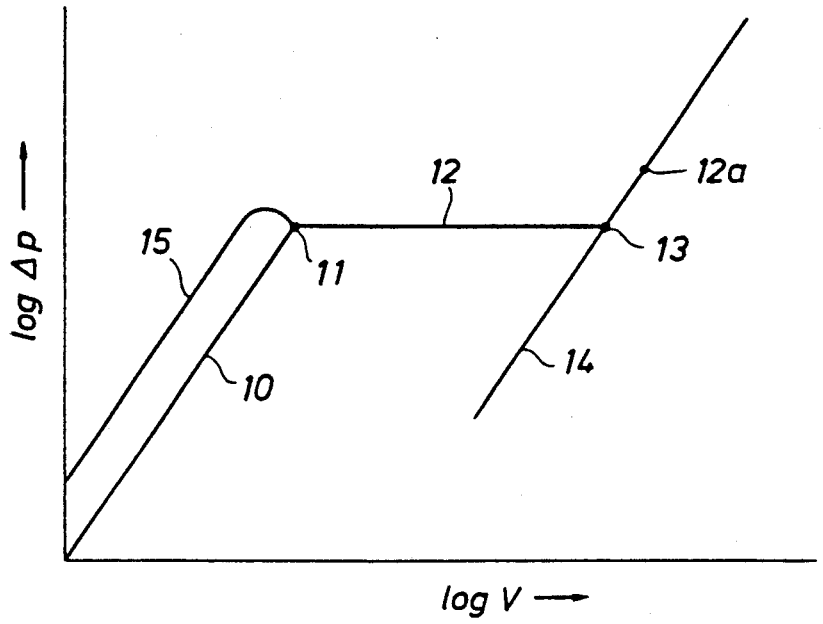
FIG. 1 is a plot of the log of the pressure differential across a fluidized bed in relation to the log of the velocity of the fluid flow through the bed.

Referring now to FIG. 1, there is shown a plot of the log of the pressure drop across the fluidized bed reactor versus the log of the velocity of the fluid flow through the reactor bed. The line 10 in FIG. 1 represents the pressure drop buildup as the velocity of the fluid flow is increased up to a point 11. At point 11 the bed of particulate matter in the fluidized reactor has expanded enough to be maintained in a fluidized state and permit the fluid to readily pass through the bed. At this point, the pressure drop across the bed is equal to the weight per unit area of the bed of particulate matter and the bed becomes fluidized. At this point the pressure drop across the fluidized bed will remain relatively constant with any further increase in velocity until the point 13 is reached. The point 13 is the intersection of the lines 12 and 14, with the line 14 representing the pressure drop through a packed bed of particulate matter in the column held back by the retaining screen at the column discharge. At this point any further increase in the velocity will cause a further pressure drop across the column as shown by the line 14. The line 15 represents the pressure drop versus velocity of fluid flow through the reactor for a fixed bed of the particulate matter held on the bottom retaining screen, in contrast to a fluidized bed.

From the above description of FIG. 1, it can be readily appreciated that if the fluidized bed column is designed so that the velocity of the purge fluid will normally be between the points 11 and 13 of FIG. 1, a constant pressure drop will be maintained across the fluidized bed. This constant pressure drop can be utilized to produce a constant positive pressure in the enclosed space. If the pressure surrounding the enclosed space increases the pressure of the purge fluid will have to increase but the differential pressure across the fluidized bed column will remain substantially the same. Thus, the enclosed space will be maintained at a positive known reference pressure in relation to the pressure of the atmosphere surrounding the enclosed space.

Figure 2:
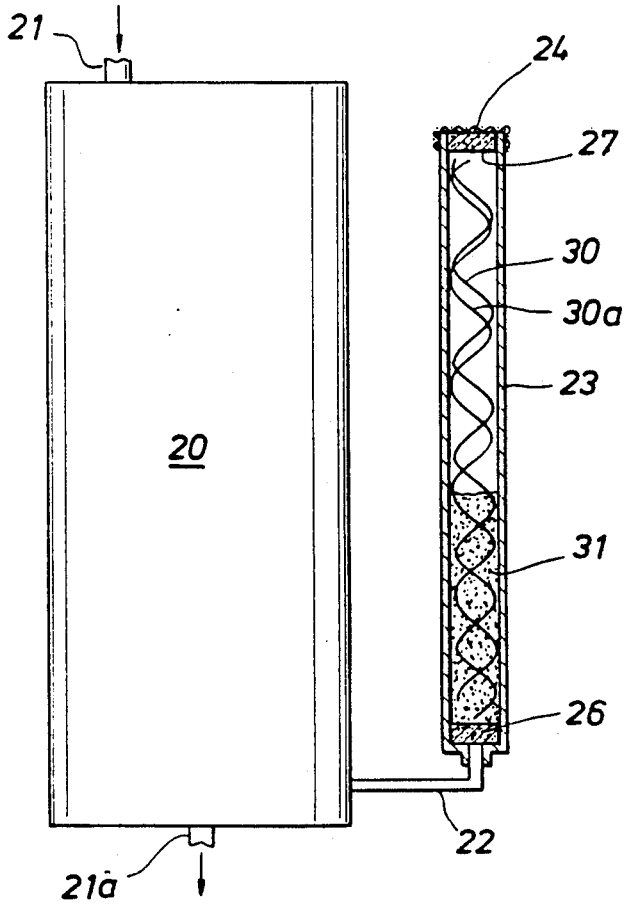
FIG. 2 is an elevation view of one embodiment of the invention for venting an enclosed space.

Referring to FIG. 2, there is shown the venting means of the invention applied to an enclosed space 20. The enclosed space may, for example, be machinery in a chemical plant where it is desired to exclude the atmosphere of the plant from the machinery to prevent damage to the machinery. Also, it may comprise a tool that is lowered into a borehole to make measurements within the borehole and it is desired to exclude the borehole fluids from the tool. This is particularly the case where the tool includes rotating means and shafts that pass through seals to rotate devices within the borehole. While the seals will effectively exclude majority of the borehole fluids from the interior of the tool, some leakage will occur. Since in many instances, borehole fluids can be corrosive, it is desirable to maintain a positive pressure differential between the interior of the tool and the borehole fluids. In all of the above situations it is customary to supply a pressurized purge fluid to the enclosed space and vent the fluid from the space to maintain the positive pressure differential between the enclosed space and the atmosphere. Normally, the purge fluid will be a gas, for example nitrogen, since gases are easier to handle than liquids.

Fluid enters the enclosed space through an inlet conduit 21 and exits through another 21*a*. Preferably the fluid outlet 21*a* is at a constant flow and pressure difference. The exit may be, for example, a motor shaft seal. The enclosed space is coupled by means of a conduit 22 to the interior of the fluidized bed column 23. The fluidized bed column preferably has a large length-to-diameter ratio, preferably exceeding 5 to 1 and more preferably between 10 and 100. The exact size of the fluidized bed column will depend upon the quantity of fluid it must vent from the enclosed space and the desired pressure drop. For example, in order to vent approximately 0.44 SCFM of nitrogen from an enclosed space where the atmospheric pressure surrounding the enclosed space is approximately 14.7 psia, a column having a length of 12 inches and a diameter of 0.218 inches inside diameter was found to be adequate, giving a pressure drop across the bed of 2.1 inches of mercury. The depth of the bed just before fluidization occurred was $4\frac{1}{2}$ inches.

The top of the column is provided with a vent or outlet 24 to the atmosphere while suitable filters 26 and 27 are provided at the top and the bottom of the column for retaining the particulate matter within the column and yet permit free passage of the purge fluid through the column.

The column is filled with a particulate matter 31. For example, tungsten carbide beads having a diameter in a the range of −40 to +50 U.S. mesh may be used when it is desired to purge nitrogen under the above described conditions. For different fluids and under different conditions, a different type of particulate matter may be desirable. Rounded particulates were found to operate with less fluctuation in pressure drop than jagged particles of the same approximate size.

Positioned within the column is a helical wire arrangement 30 and 30*a* which comprises two helical wires wound in opposite directions. The helical wires should have a relatively small diamaeter when compared to the diameter fo the column but the overall diameter of the helix should approximate the inside diameter of the column. Likewise, the overall length of the helix should be approximately the length fo the column. A highly preferred feature resulting in stable performance was found to be that the two wires have a different pitch. A workable design was found to be as follows: in a 0.28 -inch inside diameter tube, one wire had a 0.850-inch pitch and the other, 0.725-inch pitch. The wires crossed each other twice in about $7\frac{3}{4}$ inches. Both wires were 0.023 inches in diameter. As explained above, the use of the helical wires prevents the gas flowing upward through the column from forming bubbles. The formation of bubbles will of course produce an erratic flow through the column and reduce the pressure differential between the enclosed space and the atmosphere surrounding the column.

From the above description it may be seen that the invention provides a relatively simple means for maintaining a positive pressure differential between the enclosed space and the atmosphere while venting a purging gas or liquid from the space. In particular, a system has been described for venting purge gas from the enclosed space utilizing a fluidized bed column. The fluidized bed column adjusts for changes in the atmospheric conditions to maintain a constant pressure drop across the column and the desired pressure differential. Further, the column is not sensitively responsive to changes in temperature and thus the temperature does not substantially affect the pressure differential being maintained between the space 20 and the atmosphere.

The operation of the invention is straightforward since it only includes building a column and coupling it to the enclosed space that is to be vented. The choice of particulate matter in the column can vary but it must be a material that will not clump or form a solid bed in the column and a particulate which can be easily fluidized by the purge fluid from the enclosed space.

What is claimed is:

1. A method for venting an enclosed space, said method comprising:

supplying a constant flow of purge fluid to the space;

venting said purge fluid through a fluidized bed column containing a preset quantity of particles; and maintaining a positive known reference back pressure on the space with respect to the atmosphere surrounding the space.

2. The method of claim 1 wherein said fluidized bed column has a length-to-diameter ratio that exceeds five to one.

3. The method of claim 2 and in addition, maintaining a uniform flow through the fluidized bed while preventing the formation of fluid bubbles therein.

4. The method of claim 1 wherein the purge fluid is a gas.

5. The method of claim 4 wherein the flow of purge gas is maintained at a substantially constant rate.

6. An apparatus for venting purge fluid from an enclosed space while maintaining a positive known reference back pressure on the space with respect to the surrounding atmosphere, said apparatus comprising:

means communicating with the space for supplying a flow of purge fluid to the space;

an enclosed elongated column, one end of said column communicating with said space, the other end of said column communicating with the atmosphere;

a particulate material, said material being disposed in said column; and a pair of closure means disposed to close said one and said other end of the column, said closure means retaining said particulate matter within said column while allowing free flow of said fluid through the column.

7. The apparatus of claim 6 wherein said closure means comprise filter elements.

8. The apparatus of claim 6 wherein the individual particles of the particulate material have a size range of between 10 and 100 U.S. mesh.

9. The apparatus of claim 6 wherein the elongated column has a length-to-diameter ratio exceeding 5.

10. The apparatus of claim 6 wherein the individual particles of the particulate material are approximately spherical in shape.

11. An apparatus for venting purge fluid from an enclosed space while maintaining a positive known reference back pressure on the space with respect to the surrounding atmosphere, said apparatus comprising:

means communicating with the space for supplying a flow of purge fluid to the space;

an enclosed elongated column, one end of said column communicating with said space, the other end of said column communicating with the atmosphere;

a particulate material, said material being disposed in said column;

a pair of closure means disposed to close said one and said other end of the column, said closure means retaining said particulate matter within said column while allowing free flow of said fluid through the column; and means disposed in said column for preventing the formation of slugs of fluid in the column.

12. The apparatus of claim 11 wherein said means for preventing the formation of slugs of fluid in the column comprises two helically wound wire members, the helix of one wire member being wound in an opposite direction to the helix of the other, and the pitch length of one wire member being greater than that of the other wire member.

13. The apparatus of claim 12 wherein said wire members extend over substantially the entire length of said column and the helix has a diameter substantially equal to the inside diameter of said column.

14. An apparatus for contacting a fluid with a fluidized bed of solid particles comprising:

a vessel enclosing an essentially vertical fluid flowpath;

a means for distributing fluid into the essentially vertical fluid flowpath in the bottom portion of the essentially vertical fluid flowpath; and two helical elements wound in opposite directions within the flowpath.

15. The apparatus of claim 14 wherein the vertical fluid flowpath is essentially cylindrical.

16. The apparatus of claim 15 wherein the helical elements are wound in a diameter which approaches the diameter of the fluid flowpath.

17. The apparatus of claim 14 wherein the helical elements are wound about an axis which is essentially the center of the fluid flowpath and essentially parallel to the fluid flowpath.

18. The apparatus of claim 15 wherein the helical elements are wires having a diameter which is relatively small compared to the diameter of the fluid flowpath.

19. The apparatus of claim 14 wherein the length of the helical elements is approximately the length of the fluid flowpath.

20. The apparatus of claim 14 wherein at least one helical element is wound in a pitch which varies from at least one other helical element.

21. The apparatus of claim 15 wherein the ratio of the length of the fluid flowpath to the diameter of the fluid flowpath is about five or more.

22. The apparatus of claim 21 wherein the length of the fluid flowpath is between 10 and 100 times the diameter of the fluid flowpath.

23. The apparatus of claim 15 wherein the internal diameter of the cylinder is between about 0.22 and about 0.28 inches.

* * * * *